United States Patent [19]

Mainord

[11] Patent Number: 4,557,203

[45] Date of Patent: Dec. 10, 1985

[54] METHOD OF CONTROLLING A RECLAMATION FURNACE

[75] Inventor: Kenneth R. Mainord, Farmers Branch, Tex.

[73] Assignee: Pollution Control Products Co., Dallas, Tex.

[21] Appl. No.: 640,393

[22] Filed: Aug. 13, 1984

[51] Int. Cl.[4] ..... F23J 3/00

[52] U.S. Cl. ..... 110/344; 110/190; 110/193; 110/210; 110/215; 110/236; 432/4; 432/19; 432/37; 432/38; 432/48; 432/72

[58] Field of Search ..... 110/185, 186, 187, 188, 110/190, 193, 203, 210, 211, 212, 213, 214, 215, 235, 236, 344, 345, 346; 432/4, 19, 37, 38, 48, 72

[56] References Cited

U.S. PATENT DOCUMENTS

| | | | |
|---|---|---|---|
| 3,310,009 | 3/1967 | Jacobs | 110/215 |
| 3,595,181 | 7/1971 | Anderson et al. | 110/190 |
| 3,602,161 | 8/1971 | Wyrough | 110/212 |
| 3,646,897 | 3/1972 | Snelling | 110/215 |
| 3,706,289 | 12/1972 | Brewer | 110/236 |
| 3,762,858 | 10/1973 | Torrence | 110/236 |
| 3,837,302 | 9/1974 | Bersier | 110/190 |
| 3,839,086 | 10/1974 | Larson | 134/19 |
| 4,181,081 | 1/1980 | Weber | 110/236 |
| 4,270,898 | 6/1981 | Kelly | 432/19 |
| 4,474,121 | 10/1984 | Lewis | 110/188 |

FOREIGN PATENT DOCUMENTS

| | | | |
|---|---|---|---|
| 0018014 | 2/1983 | Japan | 110/190 |

*Primary Examiner*—Albert J. Makay
*Assistant Examiner*—Steven E. Warner
*Attorney, Agent, or Firm*—Harold E. Meier

[57] ABSTRACT

This invention relates to an improved method of controlling temperatures within a cleaning or reclamation furnace which is normally used to reclaim metal parts contaminated with combustible materials by pyrolyzing the combustible materials. A reclamation furnace usually includes a primary heat-input burner employed to heat the contaminated parts in the primary heating chamber, an afterburner chamber contained within the heating chamber having a secondary burner to burn volatile gases which are given off by the combustible materials as the parts are heated, and two separately-controlled automatic valve and spray nozzle assemblies connected to the primary heating chamber. Each nozzle assembly is connected to a pressurized water source to deliver a water-spray injection into the heating chamber. First and second temperature sensors are located in the discharge stack leading from the afterburner chamber and in the furnace heating chamber respectively to actuate either one or both of the separately-controlled automatic valve and spray nozzle assemblies responsive to the temperature of the burned stack gases and the furnace interior temperature.

12 Claims, 4 Drawing Figures

METHOD OF CONTROLLING A RECLAMATION FURNACE

This invention relates to an improved method of controlling atmospheric conditions within ovens or furnaces and more particularly to so-called cleaning or reclamation furnaces used to reclaim metal parts contaminated with combustible substances by removing the combustible substances from the metal parts with heat in a controlled manner. The present method provides a controlled rate of combustion in a reclamation furnace to remove thermally-degradable contaminating coatings from the surfaces of the parts leaving the metal parts unaffected.

More specifically, the present invention relates to the operation of high-temperature cleaning furnaces or ovens, and more particularly to an automated method for safely controlling processing temperatures.

BACKGROUND OF THE INVENTION

1. Field of the Invention

The technology of cleaning with heat has existed for many years and has been practiced in the recovery of both consumer and industrial products. One successful consumer product is the self-cleaning oven which operates on the simple principle of using heat to clean when the oven interior becomes dirty or contaminated from baked-on food spills or grease splattering. The self-cleaning cycle is initiated by bringing the oven temperature up to about 750° to 950° Fahrenheit, substantially higher than the normal cooking termperatures of 250° to 550° Fahrenheit. The higher temperature level which is normally maintained for a suitable time period removes the baked-on organic residues by the combined action of vaporization, thermal decomposition and oxidation. The gaseous products are generally exhausted through a catalytic oxidizing unit before being discharged to the atmosphere. Any residue remaining on the interior walls of the oven is normally removed as a soft ash. The danger of fire or explosion in normal operation of a self-cleaning oven is negligible primarily due to the fact that the volume of combustible pyrolysis smoke and gases emitted is small and the concentration of combustible material in the oven interior and exhaust stream never attains an explosive or ignitable level.

In contrast, fires and explosions have occurred more frequently in early versons of heat-cleaning equipment used in industrial environments. For industrial cleaning problems, the so-called burn-off or reclamation furnaces were among the first widespread applications of using heat to remove combustible or other organic material from metal parts. Burn-off ovens have been accepted and used by industry because they offer a simple economical way to solve many industrial cleaning problems. However, along with their use, such ovens in some cases developed a pattern of somewhat poor performance and lack of confidence in their use because of occasional fires or explosions associated with their normal usage.

Originally, burn-off or reclamation furnaces or ovens did not include much more than a heated, vented chamber into which contaminated parts were loaded and heated to a processing temperature of about 700° to 800° Fahrenheit. As the temperature of the parts became elevated on heating, the organic contaminants decomposed to combustible smoke and vapors. In cases where the loading of combustible material on the parts was excessive or the heat-up rate employed was too fast and venting of the combustible gases inadequate, frequently the combustible gases could be evolved at such rate to ignite and burn in an uncontrolled manner. Normally fires and explosions have occurred where the emission rate of volatile gases from the parts became greater than the enclosure holding the parts or venting equipment could handle and the enclosure became filled with an explosive mixture of combustibles and air. Fires have resulted in warping or other damage to the parts and sometimes to the structure of the furnace or oven itself.

2. Description of the Prior Art

Over many years various improvements have been made in the design and operation of burn-off or similar reclamation furnaces. U.S. Pat. No. 3,839,086 to Larson discloses the method of injecting water spray or vapor into a rotary dryer or furnace used for removing oil from metal scrap or turnings generated during metal-working operations. As the oil was removed in the form of combustible gases, the vaporized oil would initiate a partial combustion reaction which is highly exothermic. A plurality of water injection nozzles were provided which were activated in response to a temperature sensor inside the dryer and successively to the activation of a cam-type arrangement to supply enough water to control the exothermic burning or oxidation of the oil. U.S. Pat. No. 3,544,367 to Ehrlick and Thomas discloses the use of both oil and water injection to control the combustion or oxidation reaction recurring in a metal scrap dryer. Both of the referenced patents disclose water injection as a means of controlling the highly exothermic reaction of the oil as it is vaporized and removed with heat supplied by fuel-fired burners.

U.S. Pat. No. 4,270,898 to Kelly, assigned to the same assignee as the present application, discloses an automatic control system for a reclamation furnace which comprises an automatic means for sensing the level of combustible pyrolysis smoke and gases emitted from the contaminated parts as they are heated up, coupled with a water injection system which is responsive to the smoke emission sensor to cool the furnace interior and parts and maintain the smoke emission rate at safe levels. In this manner, the emission rate of combustible pyrolysis gases emitting from the furnace interior into an afterburner chamber is maintained below a level which could lead to partial combustion, fires or explosions.

This system has some inherent deficiencies in its on-off control of the heat input burner to maintain a preselected furnace temperature. During the off cycle of the burner air can leak through the burner into the furnace causing possibly dangerous variations in oxygen content of the furnace atmosphere. Similar conditions can occur when the burner occasionally fails to restart. Also occasional plugging of the water spray nozzle tips can prevent proper furnace cooling.

In addition to the aforesaid methods using heat as the cleaning agent, additional high-temperature cleaning processes or equipment have been developed which employ other means of preventing fires or explosions in apparatus for practicing cleaning processes which emit combustible gases. U.S. Pat. No. 3,936,659 to Mainord discloses a high-temperature oven which employs inert gases to control the oven atmosphere to eliminate danger of fire or explosion while the organic contaminants on the parts are decomposed by heating. An alternate way to prevent such deleterious effects during high-temperature cleaning is to employ a vacuum within the furnace or oven thereby eliminating or reducing the oxygen level in the heating chamber.

The present invention is directed to overcoming the adherent problems of prior art systems, specifically the methods disclosed in the Kelly patent, for preventing fires or explosions in a burn-off or reclamation furnaces, wherein the heat-input burner is cycled on and off responsive to preset temperature conditions.

SUMMARY OF THE INVENTION

Accordingly, this invention provides an improved method for controlling the operation of a reclamation furnace to safely prevent possibly deleterious conditions from developing within the furnace interior. The present invention comprises an efficient method of controlling the operation of a fuel-fired high-temperature furnace employed for cleaning a wide range of metal, glass, ceramic, and other heat-resistant parts contaminated with varied amounts and chemical types of combustible thermally-degradable material. The subject method provides a process for preventing excessive temperatures, fires or explosions in such cleaning equipment with no on-off cycling of the heating means and substantially improved regulation of deleterious conditions within the furnace. The method includes adjusting the fuel-air ratio of the heat-input burner to produce combustion gases having reduced oxygen content within the major part-heating portion of the furnace and also adjusting the fuel-air ratio of the afterburner to provide excess oxygen in an afterburner chamber to insure complete combustion in the desired location of the evolving combustible gases from the contaminated parts. Thus, the inherent dangers of uncontrolled fire and explosive conditions are minimized while a given heat input to the parts is constantly maintained.

The furnace is thus able to safely handle a much wider range of contaminated parts by controlling dual maximum set-point temperatures of the exhaust gas temperatures and similarly controlling dual maximum set-point temperatures in the furnace interior, all with preferably two multiple set-point temperature controllers of known types for process control.

The present invention employs two water-spray injection systems to control the introduction of a cooling fluid such as a water to lower excessive temperatures and to lower emissions of combustible pyrolysis smoke and gases within the furnace. In the prior art the furnace temperature has been controlled by cycling the heat-input burner on and off at a pre-selected temperature or by regulating the burner output to lower firing rates. The nozzles of the two water-spray injection systems, each of which is separately operated and controlled, are located in the furnace chamber and direct a spray or mist of water over the parts being cleaned when activated by an excessive pre-selected temperature being attained in either the furnace or in the vent stack. Both of the aforesaid methods of the prior art have been found to possess certain inherent deficiencies for cleaning equipment utilized to process contaminated parts which are highly contaminated or contaminated with highly inflammable and/or explosive materials when converted to gaseous form. It has been found that emission rates of combustible pyrolysis gases vary depending on the temperature of the cleaning furnace or other parts enclosure. Such variable emission rates in some cases create dangerous conditions when the heat-input burner is cycled on and off. When the heat-input burner is cycled off at a given temperature, such action interrupts the continuous supply of preburned combustion gases from the furnace to the afterburner chamber, thus allowing air to enter the furnace and providing a potentially hazardous condition when the furnace contains substantial amounts of combustible fumes or gases. It thereby becomes more important to maintain the normal maximum purging rate of preburned combustion gases at the furnace set-point by means of continuous operation of the input burner.

In the present invention the heat-input burner is operated continuously during the cleaning cycle. To prevent overheating of the furnace due to the continuously-operating burner, furnace temperature is sensed and used to activate the water-spray nozzles of the two water injection systems. One water injection system is activated when the furnace temperature exceeds a pre-selected point. If the furnace temperature continues to rise and exceeds another set-point temperature about 50° F. higher than the first set-point, the other water injection system is activated and both water injection systems allow water to be sprayed inside the furnace until the temperature falls below both temperature set-points.

Further, this invention provides an improved method for controlling the emission rate of combustible pyrolysis gases from parts during cleaning, using the temperature of such gases, after they pass through an afterburner mixed with air and burned, as a measure of the emission rate. The temperature of the venting stack gases is sensed and used to activate the water spray nozzles of the two water injection systems. One water injection system is activated when the stack temperature exceeds a pre-selected point. If the stack temperature continues to rise and exceeds another pre-selected point about 50° F. higher than the first set-point, the other water injection system is activated and both water injection systems allow water to be sprayed inside the furnace until the temperature falls below both temperature set-points.

Another objective of this invention is to provide a method to detect partial or complete clogging or blockage of the water-spray nozzles due to foreign materials carried in the water supply or due to dissolved materials in the water supply which may be deposited as lime or calcium carbonate or other materials in the nozzles or the pipes leading to the nozzles, and should such clogging occur, to notify or warn the operator of the furnace that such clogging has occurred so that remedial action may be taken to clean the nozzles. This invention detects such clogging in either of the water injection systems by comparing the normal time that it takes for a water injection system to restore the temperature that activated that system to a pre-selected abnormal time which would be longer than the normal time. If it takes ten seconds perhaps for the water injection system to control the temperature in the furnace when it is activated, and if the water injection system stays on say fifty or sixty seconds, it may be assumed that the injection system is not able to control the temperature because it is partially or completely clogged and this condition is used to activate the clogged-nozzle warning system. If the temperature rises to the higher set-point of the furnace temperature controller, then the other water injection system will be activated to control the temperature and the furnace will continue to operate until the timed cycle is over. The clogged-nozzle warning system remains activated and locked on so that it will be seen when next the operator starts the furnace so he may take remedial action. The clogged-nozzle warning system may take the form of a light, a flashing light, a bell, horn, or buzzer, or even a more complicated form of control in which the furnace will complete its cycle but then cannot be re-started until the clogged-nozzle system is restored.

Another objective of this invention is to provide an improved method of removing combustible substances in part by melting such substances that will melt and flow at the temperatures encountered when raising furnace temperatures at starting from room temperature up to the pyrolysing temperatures. Any material which will melt and flow is collected in a pan under the parts being cleaned and directed to a chamber outside the heated pan and is subsequently removed and disposed of as solid material. Such removal of molten material greatly decreases the amount of fuel necessary to burn the pyrolysis products in the afterburner. In addition cleaning cycle times are much reduced because the amount of material is much less and consequentially the hazards of fires and explosions are reduced.

Prescribed ranges of set-point temperatures are set on a stack temperature controller and on the furnace temperature controller which sense temperatures at two locations respectively, the vent stack and the furnace chamber. When the lower set-point of the stack controller or the higher set-point temperature of the furnace controller is exceeded, one of the water-spray injection systems is activated. When the higher set-point temperature of the stack controller or lower set-point temperature of the furnace controller is exceeded, the other water-spray injection system is activated. When both conditions are met, both water-spray injections are activated. Each water-spray system is connected in a cross-over manner such that one water-spray system serves as a back-up for the other while also ensuring that one or both assemblies of water-spray nozzles can be activated and employed during every cleaning cycle where the dual lower set points are exceeded, thus reducing the possibility of nozzle clogging from rust or contaminants or disuse, and possible failure to operate.

When one or both of the water-spray assemblies is operated, the temperature within the furnace heating chamber is lowered rapidly to retard emission of contaminants from the heated parts. Once temperatures below the lower set-point temperatures at both locations are achieved by water-spray cooling, the water-spray injection is discontinued to permit continued operation of the furnace within desired limits.

An important aspect of the present invention is the maintaining of the heat-input burner in operation at all times during the cleaning cycle to ensure a constant flow of preburned partially-inert combustion gases for heating and at least partially maintaining the furnace atmosphere at a low oxygen level with the attendant feature of providing an additional safety system in the event of failure or discontinuance of operation of the heat-input burner during a cleaning cycle. If the furnace is at process temperature and loss of the heat-input burner should occur due to flame out, loss of gas pressure or other reason, a potential hazard may exist because the furnace will rapidly leak air through the burner into its interior raising the oxygen level to a dangerous level where sufficient quantities of combustible pyrolysis gases remain in the furnace to create danger of fire or explosion. In such event, another objective of this invention is to provide sensing capability for loss of the heat-input burner during the cleaning cycle and automatically activating one or more of the water-spray systems to rapidly purge existing pyrolysis gases from the furnace interior and rapidly cool the parts and lower the furnace temperature to a pre-set low-limit temperature to prevent further emission of pyrolysis gases. When the pre-set low-limit temperature is attained, water-spray systems are deactivated to prevent excessive flooding of the furnace interior.

DESCRIPTION OF THE PREFERRED EMBODIMENT

Figure 1:
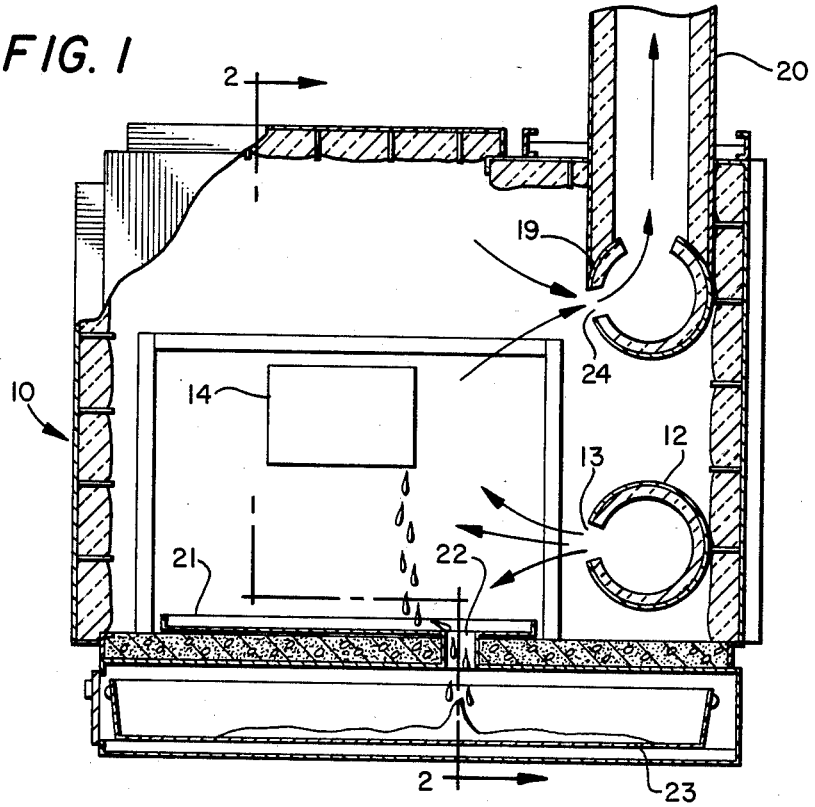
FIG. 1 is a diagrammatic view of a cleaning or reclamation furnace capable of practicing the method of the subject invention.
Figure 2:
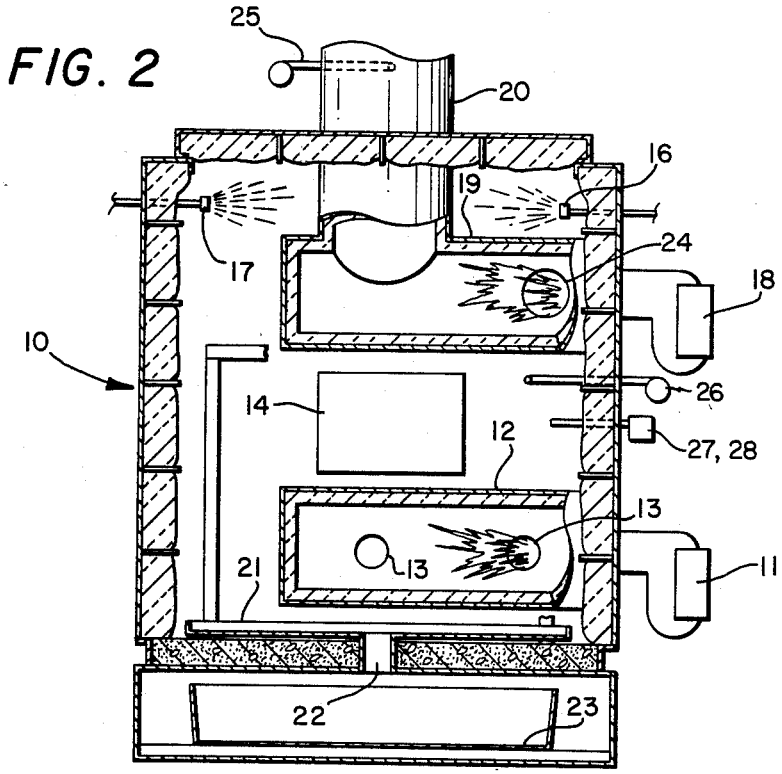
FIG. 2 is a similar diagrammatic view of the furnace taken along the line 2—2 of FIG. 1.

Referring to FIGS. 1 and 2 of the drawings, the cleaning or burn-off furnace 10 is provided with a heat-input burner 11 and combustion chamber 12, the heat-input burner being provided with suitable adjustments for setting the fuel-air mixture to provide combustion gases having low oxygen content preferably between 5 and 10% oxygen. Combustion chamber 12 has inlet openings 13 through which the hot combustion gases having low oxygen content are released into the cleaning furnace retaining the parts to be cleaned. The parts may be retained in a wire basket or other open receptacle designated by the numeral 14.

Water-spray nozzles 16 and 17 as shown in FIG. 2 are situated in opposing relation in the corners of the furnace and are each positioned to spray a fine mist of water or other suitable extinguishing fluid onto parts to be cleaned and into the surrounding atmosphere of the furnace when activated. Afterburner 18 delivers flame into afterburner chamber 19 which is contained within an upper region of the furnace having a vent stack 20 for the exhaust gases which is connected to the afterburner chamber. The fully-burned exhaust gases are passed through such stack into the atmosphere or other receiver such as a heat exchanger. A drain pan 21 is positioned within the bottom of the furnace beneath parts receptacle 14 to collect liquid-phase contaminants from the heated parts. The pan has an opening 22 to permit drainage into a collection tray 23 located beneath the furnace.

Volatile combustible pyrolysis gases given off by the contaminated parts during the cleaning process enter the afterburner chamber 19 through an opening 24 where the afterburner flame mixes the combustible gases with excess air from the afterburner to burn all of the smoke and pyrolysis gases as they flow by natural convection to the vent stack 20 and past a thermocouple 25 or other temperature sensing device located in the vent stack. Excess air of about 100 to 200% more than that required for stoichiometric operation of the afterburner 18 is introduced into the afterburner chamber. The fuel/air ratio of the afterburner is adjusted such that approximately 100 to 200% excess air is present in the afterburner (before any smoke is produced). In actual practice the fuel input of the afterburner is set at about 150,000 BTU/HR, and the blower motor air shutter is adjusted to produce a stack temperature of about 1400° F. This temperature corresponds to about 150% excess air. The stack temperature is preferably measured by one or more thermocouples 25 or other heat sensors delivering generated signals to a temperature controller, with two set-points or two or more single set-point temperature controllers As shown in FIG. 3, a furnace temperature thermocouple 26 is located within a central region of the furnace having both high and low limit controls 27 and 28 respectively.

A gas inlet valve 30 along with high and low gas pressure switches is located in the main gas line leading to primary and secondary burners 11 and 18 to deliver gaseous fuel thereto. Appropriate shut off valves are provided in this line.

A water inlet valve 31 is provided in a pressurized water line having a pressure gauge 32 therein. The water line supplies both water-injection system No. 1 designated by the numeral 33 and water-injection system No. 2 designated by the numeral 34 on FIG. 3. Water-injection system No. 1 is connected by a pipe to inlet pipe 46 which is connected to nozzle 16 inside the furnace. Water injection system No. 2 is similarly connected by a pipe (not shown) to nozzle 17 inside the furnace on the opposite side. A normally-open water valve 35 is located in the line of system No. 1 along with a water valve 37. System No. 2 designated by the numeral 34 similarly has a normally-open water valve 38, a water pressure switch 39 and a normally-closed water valve 40. Each of the systems has a manual water valve 41 and a water pressure relief valve 42.

Figure 3:
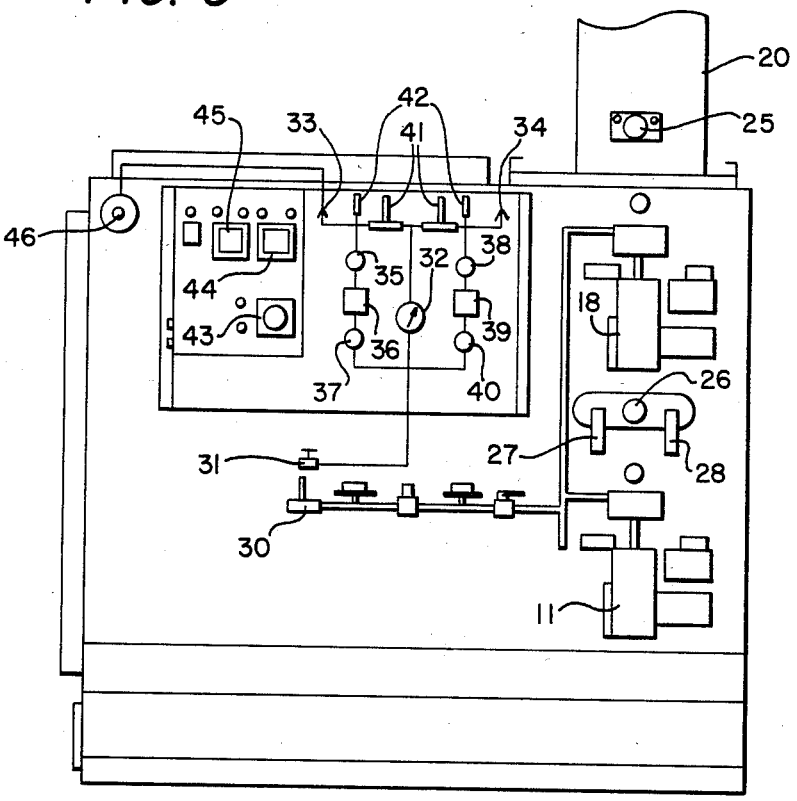
FIG. 3 is a schematic view of the operating components of the furnace shown in FIGS. 1 and 2, showing the heat input and water-injection-spray systems.

As further shown in FIG. 3, a cycle timer 43 is provided along with a stack temperature controller 44 and a furnace temperature controller 45. Each temperature controller has two temperature set-points, usually set about 50° F. apart called lower and higher set-points.

When the cycle timer 43 is started, the heat-input burner 11 and the afterburner 18 are both operated continuously. When pyrolysis gases are evolved from the contaminated parts in the open receptacle 14 in the furnace interior into the afterburner chamber 19 and vent stack 20, the additional heat supplied by burning the pyrolysis gases in the afterburner chamber is sensed by the vent stack thermocouple 25 connected to the stack temperature controller 44. When the lower set-point of the stack temperature controller 44 is exceeded, normally-open valve 38 of water injection system No. 2 is de-energized allowing the water-spray nozzle 17 to become operative to cool the parts with water. When the temperature at the vent stack thermocouple 25 falls back below the lower set-point temperature of the stack temperature controller 44 water valve 38 is re-energized and water spray stops. This on-off control mode of water-spray nozzle 17 thus limits the amount of pyrolysis smoke and gases emitted to the afterburner chamber 19 according to the lower set-point of the stack temperature controller 44. The higher the preselected setting of the lower set-point of the stack temperature controller 44, the greater the allowed emission rate of pyrolysis gases from the parts because it takes more gases to raise the stack temperature over its idle or no-emissions temperature. In practice the lower set-point of the stack temperature controller 44 cannot be raised beyond a limit determined by the amount of available excess air from the afterburner. If the rate of emission of pyrolysis gases through the afterburner chamber 19 is higher than the available excess air from the afterburner, then insufficient air will be available to burn all the pyrolysis smoke and gases and complete incineration of such gases will not be achieved.

If water spray from nozzle 17 is insufficient to control the stack temperature at its lower set-point, or should nozzle clogging occur, or should failure of any of the components of water injection system No. 2 prevent water spray from being delivered into the furnace, then the stack temperature will continue to rise. If the vent stack temperature exceeds the higher set-point on the stack temperature controller 44 then valve 35 of water injection system No. 1 will be de-energized allowing it to open and cause delivery of water through water spray nozzle 16 to further cool down the parts and control emission rates of pyrolysis gases. In this fashion water injection system No. 1 acts as a back-up in the event of failure of water injection system No. 2 for any reason, or the inability of system No. 2 to control the stack temperature-lower temperature set-point of the stack temperature controller 44.

The furnace temperature is sensed by the furnace temperature thermocouple 26 which also serves to control operation of the water spray systems. When the lower of the two set-point temperatures of the furnace temperature controller 45 is exceeded, water valve 35 is de-energized and water spray occurs through nozzle 16 of water-spray System No. 1. If furnace temperature continues to rise and exceeds the preset higher set-point temperature value on the furnace temperature controller, then water valve 38 is de-energized and water spray System No. 2 (nozzle 17) sprays a fine mist of water into the furnace interior to additionally control the furnace atmosphere temperature.

By having water valve 35 responsive to the minimum lower of the two set-points of the furnace temperature controller and to the higher of the two set-points of the stack temperature controller, and by having water valve 38 responsive to the lower set-point temperature of the stack temperature controller and to the higher set-point temperature of the furnace temperature controller, the crossover network assures that one or both water-spray systems will be activated during a sufficient time period of each cleaning cycle. This occurs because the lower set-point temperature of the furnace temperature controller will be reached in every normal cleaning cycle as this represents the normal process temperature within the furnace while the lower of the two set-point temperatures of the stack temperature controller will be reached in every cleaning cycle where sufficient amount of pyrolysis smoke and gases are generated to exceed such lower set-point of the stack temperature of the stack temperature controller. In practice this occurs in most cleaning cycles where the parts have any appreciable amount of contaminants.

Valves 37 and 40 are normally-closed (N-C) valves requiring power to open them, while valves 35 and 38 are normally-open (N-O) valves requiring power to close them. In normal operation, with no power to the furnace, valves 37 and 40 are closed while valves 35 and 38 are open. Thus, no water-spray can occur. When the power switch to the furnace is turned on, the N-C valves then open and N-O valves are powered closed. This allows water to flow through the water pressure switches 36 and 39 and activates them. No water-spray occurs until the temperature controller set-points are reached. When this occurs, power is interrupted, valves 35 and 38 de-energize open, allowing water-spray. When the temperature falls back below the given set-point, power is again supplied to valve 35 or 38 and water-spray stops. Should there be insufficient water supply pressure or should the water supply be interrupted, the water pressure switches 36 and 39 will act to cut off the heat-input burner.

Should the heat-input burner 11, or afterburner 18, flame-out or otherwise be extinguished for any reason, such as tripping of the low or high gas pressure switches during normal operation, this condition is sensed by opening of the Interlock Relay contacts 49. If the furnace is in its timed cycle and the furnace temperature is above about 500° F., then power is lost to both water valve 35 and water valve 38, activating automatic safety cool-down with both water-spray systems until the furnace temperature falls below 500° F. When about 500° F. is reached, power is restored to the water valves 35 and 38 through the normally-closed contacts 51 of the Low-Limit Temperature Controller. The Low-Limit Temperature Controller is normally set at about 500° F., such that its N-C contacts 51 are closed below this temperature and open above it. Power to hold water valves 35 and 38 closed comes from three parallel circuits; through the N-C contacts 50 of the cycle timer, the N-C contacts 51 the Low-Limit Temperature Controller, and the N-O contacts 49 of the Interlock Relay (which are closed when burners are on). When the furnace is in a timed cleaning cycle, the N-C cycle timer contacts 50 are open and when the furnace temperature is above the set point of the Low-Limit Temperature Controller, about 500° F., its N-C contacts 51 are open. Power to keep the N-O water valves 35 and 38 open is then supplied only through the N-O contacts 49 of the Interlock Relay. If the heat-input burner flame is lost for any reason, the Interlock Relay N-O contacts open and automatic water-spray occurs until the furnace temperature falls below the set point of the Low-Limit Temperature Controller, which then sends power to close the water valves and stop the water-spray. Below 500° F., smoke production is presumably nil and any potential for fire or explosion is then eliminated.

Figure 4:
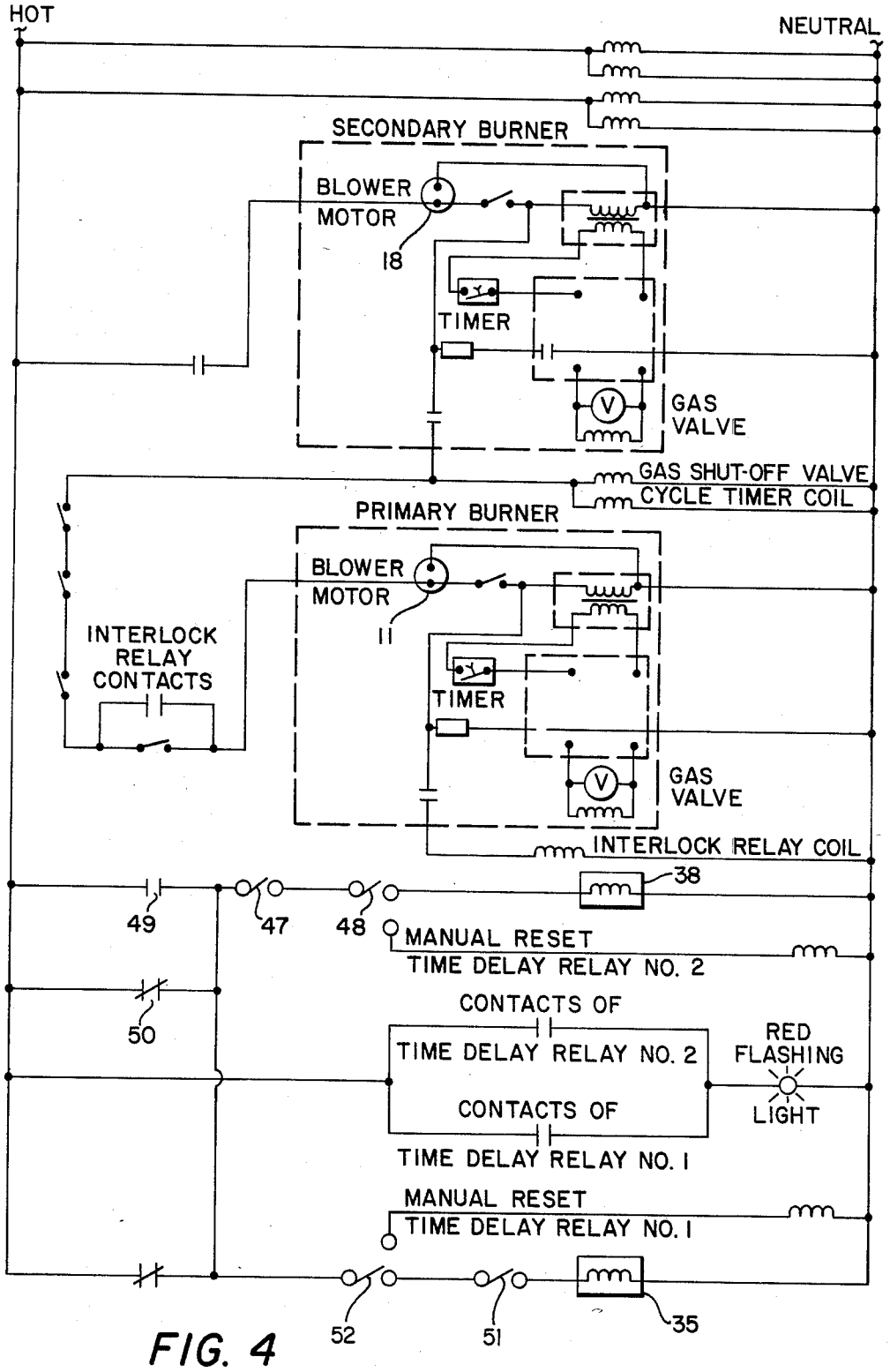
FIG. 4 is a schematic view of the control and wiring systems of the burner and water valve assemblies in simplified form for practicing the method.

FIG. 4 illustrates in simplified schematic form the circuitry for controlling the two water-injection systems. Water spray nozzle 16 is operated by water valve 35 which is activated by the higher set-point 51 of the stack temperature controller or lower set-point 52 of the furnace temperature controller 45. Water-spray nozzle 17 of System No. 2 is operated by valve 38 which is activated by the furnace temperature higher set-point 47 or stack temperature lower set-point 48. Both water valves 35 and 38 are normally-open valves and are powered-closed. Activation of water-spray by either valve is caused by loss of power to the valve, causing it to open and spray water. Restoration of power again closes the valve.

Heat-input burner 11 and afterburner 18 are shown with their respective blower motors, gas valves, timers, and primary control circuits. The circuitry has additional elements not shown which operate the water delivery valves 35 and 38 upon flame-out or interruption of either of the burners.

The circuitry provides a cross-over arrangement so that when either the higher set-point temperature of the stack gases or the lower set-point of the furnace chamber is exceeded, the first water spray is operated to cool the heating chamber of the furnace. Conversely, when either the lower set-point temperature of the stack gases or the higher set-point temperature of the furnace chamber is exceeded, the second water spray is operated to cool the heating chamber. Normally both of the water sprays will be operated during each heating cycle of contaminated parts.

The two water-sprays of the present invention are separately controlled by independently-actuated water valves which are operated in response to the prescribed set-points on the stack and furnace temperature controllers.

The present method includes elements to detect flame-out or discontinued operation of either the heat input burner or the afterburner. Upon such detection, both water-injection systems are actuated to cool the furnace interior and heated parts, and to purge any combustible smoke or pyrolysis gases from the furnace chamber.

As stated hereinabove, delivery of excess air on the order of about 100 to 200% more than required for optimum burner operation is delivered into the afterburner chamber to ensure complete combustion of essentially all combustible gases emitted from the parts. By maintaining a low-oxygen level in the furnace heating throughout all periods of operation, the development of possibly hazardous conditions interiorly of the furnace is avoided. The higher oxygen level in the afterburner chamber assists in burning all combustibles therein prior to their exiting from the furnace, thus emissions are void of unburned hydrocarbons.

In the present invention it becomes especially important to have some type of warning system to determine when one or the other of the two water spray nozzle systems becomes clogged, or partially clogged, such that an inadequate amount of water-spray is available to control processing temperatures.

The two water-spray systems of this invention control not only the rate of evolution of smoke from the parts (by limiting the stack temperature to about 1500° F.) until all the organic matter is vaporized or otherwise decomposed, but also the furnace temperature at its normal processing temperature of about 900° F. Because the heat-input burner operates continuously during a normal cleaning cycle, it is especially important that the water-sprays operate correctly to prevent the furnace temperature from developing dangerous over-temperature conditions. If one water-spray nozzle system should become clogged, the other system should take over and control the stack temperature at its higher set-point or the furnace temperature at its higher set-point. If both nozzles should clog, then when a furnace temperature of about 1000° F. is reached, a manual-reset high-limit temperature controller terminates power to the heat-input burner to prevent possible damage to the furnace itself.

In the event that only one of the water-spray systems should become clogged, it is important to have some means of detecting it and correcting the situation before the other nozzle system also clogs. This can be accomplished in one manner as follows:

Electrically, two manual-reset, locking, time-delay relays and a flashing red light preferably constitute the warning system. The system works as follows:

Time Delay Relay #1 (TDR #1) is connected to the furnace temperature lower set-point such that when this temperature, normally about 900° F. is exceeded, water valve #1 is de-energized while simultaneously power is switched to energize the coil of T.D.R. #1 starting its timing circuitry.

If power is continuously maintained to the relay for its time setting of about 45 seconds, the relay will close and lock its set of contacts which sends power to a flashing red light located on the control panel, or other appropriate location. The flashing red light will indicate that the furnace temperature lower set-point has been exceeded for an excessively long period of time (45 seconds).

The T.D.R. #1 has a set of contacts which are locked closed once the relay times out. To reset the relay, power must be removed and a manual reset button located on the top of the relay must be pushed. Normally the relay is located inside the control box which must be opened to manually reset the relay. Simply turning off the power to the unit will of course turn off the light, but when the power switch is turned back on the light will flash again, warning of the clogged nozzles. It takes a conscious act of opening the control box to turn off the alarm light. In a similar manner a second (identical) locking Time Delay Relay #2 is connected to the stack temperature lower set-point such that when this temperature (usually 1500° F.) is exceeded for 45 seconds, T.D.R. #2 would time out, close and lock its set of contacts and turn on the flashing red light and indicate that nozzle clogging had occurred. Of course, if only one light is used, the operator must check the system to see which is clogged. If two lights were used, each light could indicate specifically which nozzle system had clogged.

The time setting on the Time Relay Relays is rather arbitrary and depends on the controlling power of the water spray systems themselves. For example, with one type of commercial furnace the number of nozzles and the volume of water passed through the nozzles are such that under normal processing conditions, the water-spray time required to control the stack temperature at its low set-point of 1500° F. or the furnace temperature at its low set-point of 900° F. is usually only about two to ten seconds.

If one of the water-spray nozzle systems becomes clogged, the lower set-point would be exceeded and the furnace or stack temperature would then be controlled at its higher set-point (950° F. for furnace temperature higher set-point, 1550° for higher set point of the stack temperature). After the lower temperature of either controller is exceeded for 45 seconds (or some other arbitrary number that is longer than the "normal" water-spray time), the flashing red light would come on.

The lower set-point of the stack temperature controller or the lower set-point of the furnace temperature controller would be exceeded for a time period of 45 seconds or longer only when:

A. One of the two water-spray nozzle systems is clogged; the unit will operate over its lower set-point. After 45 seconds, the flashing red light will come on.

B. Furnace should be loaded with an abnormal material and an abnormally long water-spray time is required to control processing temperatures, then the red warning light would also come on after 45 seconds. In this case the warning light would be indicating an overloaded condition rather than actual clogging of the water-spray nozzle systems. A careful review of the situation should determine which condition activated the alarm light.

Then in actual practice the red warning light could indicate one of several dangerous conditions, 1. The nozzles system could be completely clogged preventing any water-spray from entering the furnace.
2. The nozzle system could be partially clogged such that only limited amounts of water-spray entered the furnace, therefore causing abnormally long water-spray times to control processing temperatures.
3. An actual fire or other higher exothermic condition could have occurred during the cleaning cycle such that abnormally long water-spray time occurred.

If after a cleaning cycle, an operator observed the red warning light at a later period, the operation of the furnace should be checked to determine if either of the water-spray systems were clogged.

Various modifications may be resorted to within the spirit and scope of the appended claims.

I claim:

1. In a reclamation furnace having a primary heat-input burner connected to a combustion chamber, internal structure within the furnace for supporting reclaimable contaminated parts, a secondary burner connected to an afterburner chamber having an exhaust gas stack, said secondary burner and afterburner chamber combinedly comprising an afterburner for burning contaminants, the afterburner chamber being located within the furnace along with said internal structure for supporting reclaimable parts, a method for controlling the atmosphere and temperature within said reclamation furnace comprising the steps of:

(a) heating said contaminated parts within said furnace with a continuously-operated primary heat-input burner;

(b) controlling the air-fuel combustion mixture delivered to said primary heat-input burner to maintain a relatively low oxygen level;

(c) burning combustible gases emitted from said heated contaminated parts within said afterburner chamber with a continuously-operated secondary burner;

(d) continuously sensing within both said exhaust gas stack and said furnace prescribed ranges of low and high set-point temperatures of the burned stack gases and the interior of the said furnace;

(e) actuating the injection nozzle of a first separately-controlled water-injection system when the prescribed low-level set-point temperature of stack gases or the high-level set point temperature of said furnace is exceeded to inject a first water-spray into said furnace to cool the interior thereof;

(f) actuating the injection nozzle of a second separately-controlled water-injection system when the prescribed high-level set-point temperature of said stack gases or the low-level set-point temperature of said furnace is exceeded to inject a second water-spray into said furnace to cool the temperature within said furnace, and (g) discontinuing operation of either or both of said separately-controlled water-injection systems when temperatures below the prescribed low-level set-point temperatures of both said stack gases and said furnace are attained to discontinue water-spray injection into said furnace to thereby cease cooling of said heated parts.

2. The method in accordance with claim 1, including the step of maintaining a low-level oxygen content in the air-fuel combustion mixture delivered to said primary heat-input burner in step (b) to produce combustion gases not in excess of about 10% oxygen.

3. The method in accordance with claim 1, wherein said first and second water-injection systems comprise independent automatic valve and spray nozzle assemblies, each connected to a pressurized water source, which systems are responsive to and separately controlled by the low and high level set-point temperatures of at least one process temperature controller.

4. The method in accordance with claim 3, including the step of interconnecting said first and second water-injection systems in such manner that each system serves as a backup to the other to ensure that one or both of the water injection systems is activated when the higher of the high-level set point temperatures is exceeded.

5. The method in accordance with claim 1, including the step of providing means to detect flame-out or discontinued operation of either the primary heat-input burner or the secondary burner in said afterburner chamber and upon such detection thereby activating at least one of the separately-controlled water-injection systems to cool the burning combustible gases and heated parts within said furnace.

6. The method in accordance with claim 1, including the step of providing means to effect alternating operation of the first and second separately-controlled water-injection systems when the first prescribed low-level set-point temperature of said exhaust gases or the second prescribed high-level set-point temperature of the interior of the furnace is exceeded to ensure that both injection nozzles are fully operable and that each serves as a readily-available backup for the other.

7. The method in accordance with claim 1, including the steps of delivering excess air to the secondary burner in said afterburner chamber to ensure complete combustion within said afterburner chamber of all combustible volatile gases emitted from said heated parts.

8. The method in accordance with claim 1, including the step of discontinuing operation of either or both of said separately-controlled water-injection systems as set forth in step (g) when a minimum low-level interior temperature below about 500° F. is attained in said furnace following water-spray injection.

9. The method in accordance with claim 1, including the step of providing a warning signal when either one or both of said separately controlled water-injection systems fails to deliver water spray interiorly of said furnace upon command of a prescribed set-point temperature being exceeded in either said stack gases or said furnace interior.

10. The method in accordance with claim 1, including the step of providing a collection tray beneath said furnace for collecting liquid-phase contaminants from said heated parts through an opening in the furnace bottom.

11. The method in accordance with claim 1, including the steps of maintaining the combustion gases produced within said furnace interior not in excess of about 10% oxygen and delivering excess air in the amount of 100 to 200% excess air to the secondary burner in said afterburner chamber to ensure complete combustion of combustible pyrolysis gases therein.

12. In a reclamation furnace for cleaning contaminated parts, said furnace having a primary heat-input burner connected to a combustion chamber, internal structure within the furnace for supporting reclaimable contaminated parts, a secondary upper burner connected to an afterburner chamber having an exhaust gas stack, said secondary upper burner and afterburner chamber combinedly comprising an afterburner for burning contaminants, the afterburner chamber being located within the furnace above said internal structure for supporting reclaimable parts, a method for controlling the atmosphere and temperature within said reclamation furnace comprising the steps of:

(a) heating said contaminated parts within said furnace with a continuously-operated primary lower heat-input burner, (b) controlling the air-fuel combustion mixture delivered to said primary lower heat-input burner to maintain a relatively low oxygen level interiorly in the part-heating area of said furnace not in excess of about 10% oxygen, (c) burning combustible gases emitted from said heated contaminated parts within said upper afterburner chamber with a continuously-operated secondary upper burner, (d) continuously sensing within both said exhaust gas stack and said furnace prescribed ranges of low and high set-point temperatures of both the burned stack gases and furnace interior adjacent the contaminated parts, (e) actuating the injection nozzle of a first separately-controlled water-injection system when the prescribed low-level set-point temperature of said stack gases or the high-level set-point temperature of said furnace is exceeded to inject a first water-spray into said furnace to cool the heated parts and lower the interior temperature of said furnace;

(f) actuating the injection nozzle of a second separately-controlled water-injection system when the prescribed high-level set-point temperature of said stack gases or the low-level set-point temperature of said furnace is exceeded to inject a second water-spray into said furnace to cool the heated parts and lower the interior temperature of said furnace; and (g) discontinuing operation of one or both said separately-controlled water-injection systems when temperatures below the prescribed low-level set-point temperatures of both said stack gases and said burner are attained to discontinue water-spray injection into said furnace and thereby cease cooling of said heated parts and the furnace interior.

* * * * *